US005267364A

United States Patent [19]

Volk

[11] Patent Number: 5,267,364

[45] Date of Patent: Dec. 7, 1993

[54] THERAPEUTIC WAVE MATTRESS

[75] Inventor: Craig K. Volk, San Antonio, Tex.

[73] Assignee: Kinetic Concepts, Inc., San Antonio, Tex.

[21] Appl. No.: 927,957

[22] Filed: Aug. 11, 1992

[51] Int. Cl.[5] ..... A47C 27/10; A61G 7/04

[52] U.S. Cl. ..... 5/453; 5/455; 5/465; 5/470; 5/914

[58] Field of Search ..... 5/453, 455, 456, 469, 5/470, 465, 914

[56] References Cited

U.S. PATENT DOCUMENTS

| | | | |
|---|---|---|---|
| 796,722 | 8/1905 | Hermann | 5/499 |
| 3,678,520 | 7/1972 | Evans | 5/453 |
| 4,193,149 | 3/1980 | Welch | 5/453 X |
| 4,999,867 | 3/1991 | Toivio et al. | 5/453 X |
| 5,081,728 | 1/1992 | Skinner | 5/470 X |
| 5,090,077 | 2/1992 | Caden et al. | 5/453 X |
| 5,121,512 | 7/1992 | Kaufman | 5/453 |

FOREIGN PATENT DOCUMENTS

| | | | |
|---|---|---|---|
| 8908439 | 9/1989 | European Pat. Off. | 5/453 |
| 1545806 | 5/1979 | United Kingdom | 5/455 |

*Primary Examiner*—Michael F. Trettel

[57] ABSTRACT

A therapeutic mattress for bed ridden patients comprises a plurality of inflatable tubular elements fabricated from a low air loss material which are disposed in side by side, transverse relationship to a mattress supporting surface. The air pressure within the various tubular elements is cyclically varied to produce a wave-like deformation of the patient supporting surfaces of the tubular elements which progresses longitudinally along a selected portion of the length of the mattress.

3 Claims, 6 Drawing Sheets

THERAPEUTIC WAVE MATTRESS

BACKGROUND OF THE INVENTION

1. Field of the Invention

This invention relates to a mattress for supporting bedridden patients in a manner that helps prevent and treat complications of immobility such as skin breakdown and decubitus ulcers. More particularly, this relates to a patient supporting mattress overlay or other support employing a plurality of transverse inflatable tubular elements sequentially inflated and deflated to provide a therapeutic wave beneath the patient.

2. Background Art

It has long been known that bedridden patients may be spared the discomfort of bed sores and other complications by providing frequent changes and periodic reductions in the pressure points of the patient supporting mattress against the patient's body. A number of prior patents disclose patient supporting mattresses formed by a plurality of inflatable bag or sack elements formed from a low loss air material. See for example, U.S. Pat. No. 5,003,654 wherein a plurality of inflatable sacks, having a complex top surface configuration when inflated, are disposed in side by side transverse relationship on a mattress supporting surface of a hospital bed. When alternate sacks are inflated, accompanied by current deflation of the intermediate sacks, the patient is moved with a rolling motion from a position wherein one side of the patient's body is supporting most of the weight of the body, to an alternate position wherein the other side of the patient's body provides the primary support. While this mattress arrangement is very effective in eliminating bed sores, the complexity of the transversely disposed, inflatable bag elements makes the total mattress more costly than desired.

There is a need, therefore, for a therapeutic mattress employing a plurality of transversely disposed inflatable elements which are capable of producing a desired movement of the mattress supporting points relative to the patient's body, and which can be manufactured at a cost substantially less than that of prior art constructions.

SUMMARY OF THE INVENTION

This invention provides a therapeutic mattress for prevention of bed sores on bed ridden patients, comprising a plurality of simple tubular inflatable elements formed of a low air loss material. The inflatable tubular elements are mounted in transverse, side by side relationship on the top of a generally rectangular foam pad whose dimensions conform to that of the mattress supporting surface of the hospital bed. The foam pad has an upstanding wall of fabric perimetrically secured to its edges. The inflatable tubular elements are disposed within the confines of the upstanding wall, extending transversely across the entire pad surface and lying in side by side relationship to cover the full length of the underlying foam pad mattress base. Detachable connectors are provided between the ends of the inflatable tubular elements and the upstanding wall.

A box-like housing is provided which may be conveniently hung on the footboard of the bed and which contains an electric motor driven pump for producing an output of pressured air. The pressured air is directed to a manifold wherein it is divided into a plurality of streams, preferably three. The three streams of pressured air are then directed through three electrically variable, pressure reducing valves and the outputs of such valves are respectively connected to three flexible primary conduits which pass along one side of the array of inflatable elements, being disposed intermediate the ends of the elements and the upstanding retaining wall and, if desired, restrained by the detachable connectors.

Each conduit supplies fluid pressure to a group of longitudinally spaced inflatable tubular elements. In a preferred embodiment of the invention, the first tubular inflatable element adjacent the footboard, the fourth tubular inflatable element from the footboard, the seventh, etc. are interconnected by flexible secondary conduits and connected to one of the three primary conduits supplying pressured air. The second primary pressured air conduit is connected to the second, fifth, eighth, etc. inflatable tubular element, while the third primary pressured air conduit is connected to the third, sixth, ninth, etc. inflatable tubular element spaced from the footboard. In other words, groups of longitudinally spaced, inflatable tubular elements are respectively supplied with a variable air pressure from the air pressure controlling valves, preferably in a manner that produces a wave-like progression beneath the patient. The resulting waves rythmically massage the patient's skin to further stimulate blood circulation and oxygenation in the skin.

As previously mentioned, each of the air pressure controlling valves are electrically operated, as by a small motor, and an appropriate electrical control circuit permits the sequential actuation of such valves so that the pressure in each group of longitudinally spaced, inflatable tubular elements may be sequentially and cyclically increased and decreased. The net result of such sequential pressure cycling is to cause the upper or patient supporting surface of each tubular element to slightly raise and lower in sequence, resulting in a wave of movement of the patient supporting surface that progresses from the foot of the bed to the head of the bed or vice versa. Such wave action may be continuous or intermittent, depending on the manual setting of the control circuit. The actual amount of pressure increase or decrease is preferably kept at a minimum because all that is desired, for elimination of bed sores, is a periodic reduction in the amount of pressure exerted on each part of the patient's body which is supported by the inflatable tubular elements. It is also thought that sequential pressure fluctuations create a therapeutic wave which rythmically massages the patient to stimulate circulation.

A therapeutic mattress embodying this invention will obviously be much less costly to manufacture than the aforementioned prior art mattresses and yet will produce equally efficient results in minimizing the occurrence of bed sores on a bed ridden patient.

Further objects and advantages of the invention will be readily apparent to those skilled in the art from the following detailed description, taken in conjunction with the annexed sheets of drawings, on which is shown a preferred embodiment of the invention.

1, illustrating a normal or level position of the patient supporting inflatable air bags.

Figure 1:
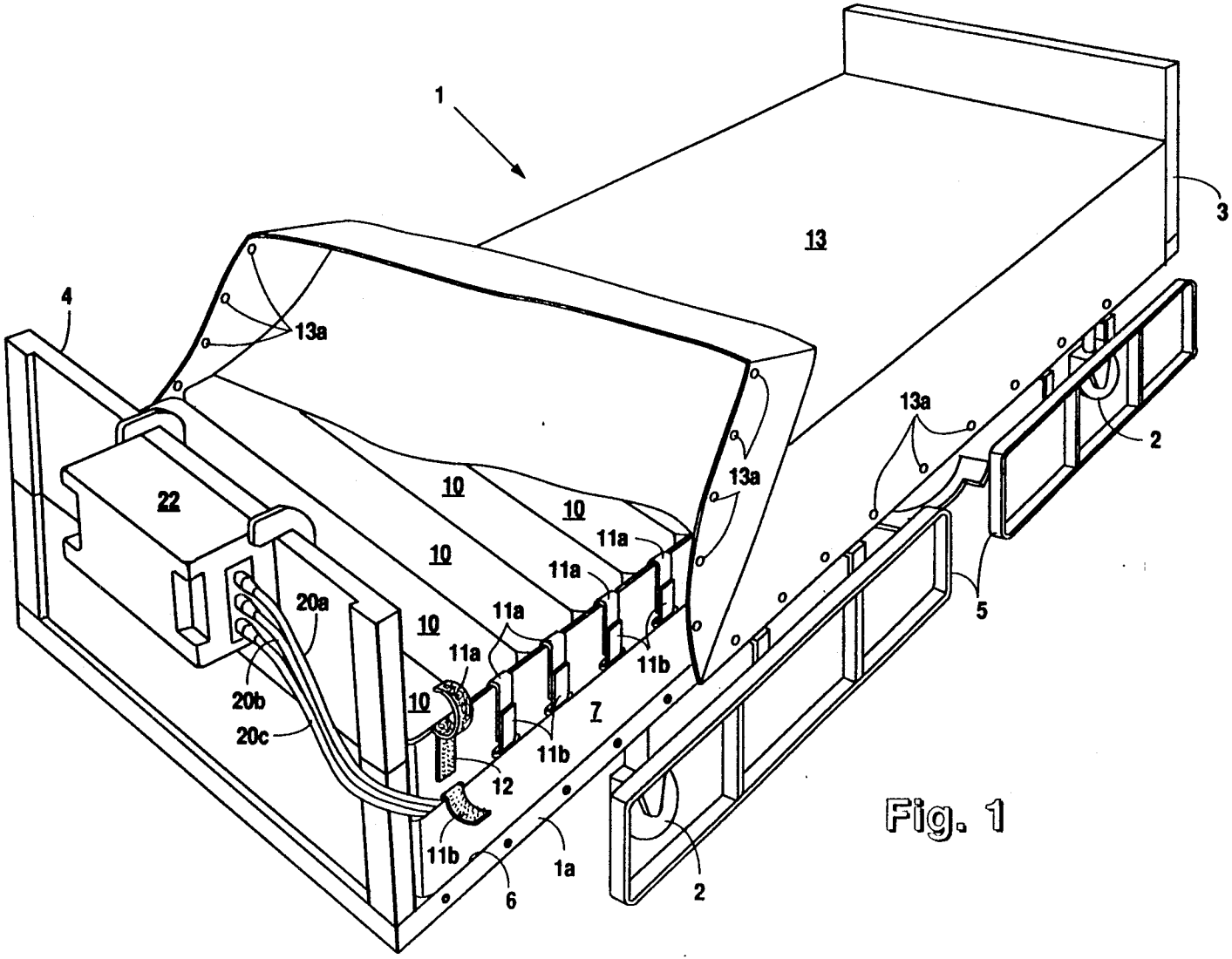
FIG. 1 a perspective view of a conventional hospital bed on which a therapeutic mattress embodying this invention is mounted.
Figure 2A:
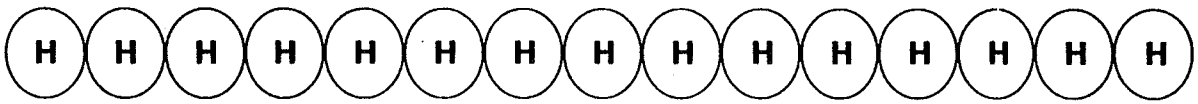
FIG. 2A is a schematic vertical sectional view of the inflatable tubular air bags assembled on the bed of FIG.
Figure 2B:
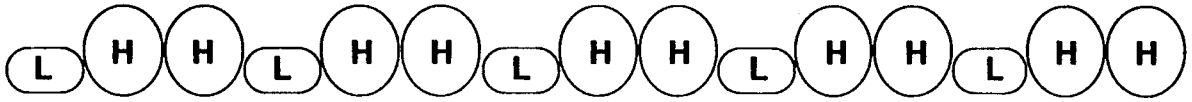

FIG. 2B is a view similar to FIG. 1 but illustrating in exagerated dimensions a first change in the relative inflation of longitudinally spaced groups of inflatable, patient supporting bags.

Figure 2C:
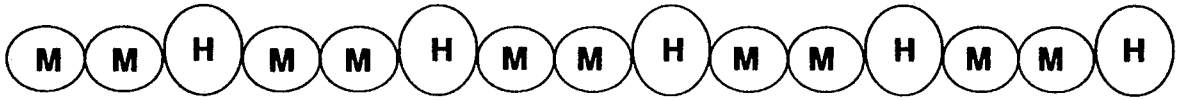

FIG. 2C a view similar to FIG. 1 but illustrating in exaggerated dimensions a second change in the relative inflation of longitudially spaced groups of inflatable, patient supporting bags.

Figure 2D:
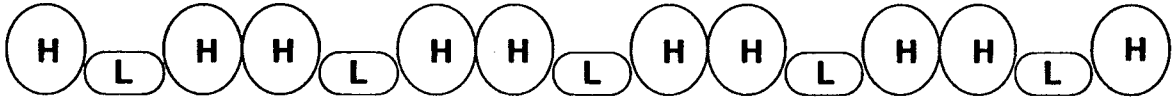

FIG. 2D is a view similar to FIG. 1 but illustrating in exaggerated dimensions a third change in the relative inflation of longitudinally spaced groups of inflatable, patient supporting bags.

Figure 2E:
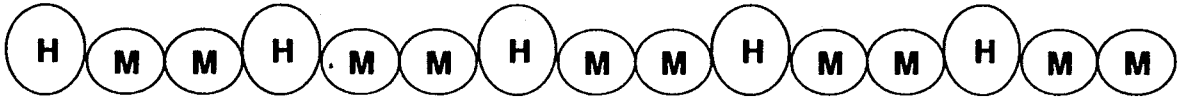

FIG. 2E is a view similar to FIG. 1 but illustrating in exaggerated dimensions a fourth change in the relative inflation of longitudinally spaced groups of inflatable patient support air bags.

Figure 2F:
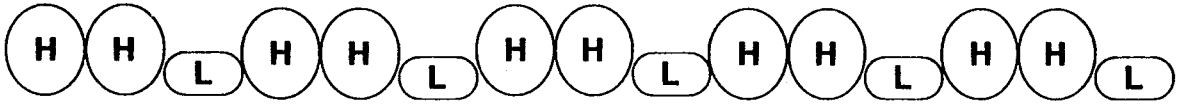

FIG. 2F is a view similar to FIG. 1 but illustrating in exaggerated dimensions a fifth change in the relative inflation of longitudinally spaced groups of inflatable, patient supporting air bags.

Figure 2G:
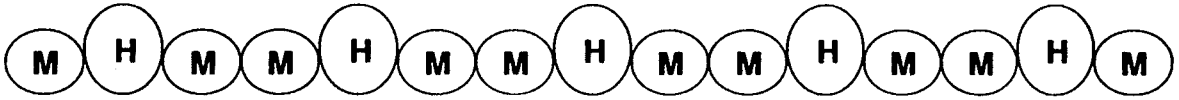

FIG. 2G is a view similar to FIG. 1 but illustrating in exaggerated dimensions a sixth change in the relative inflation of longitudinally spaced groups of inflatable, patient supporting air bags.

Figure 3:
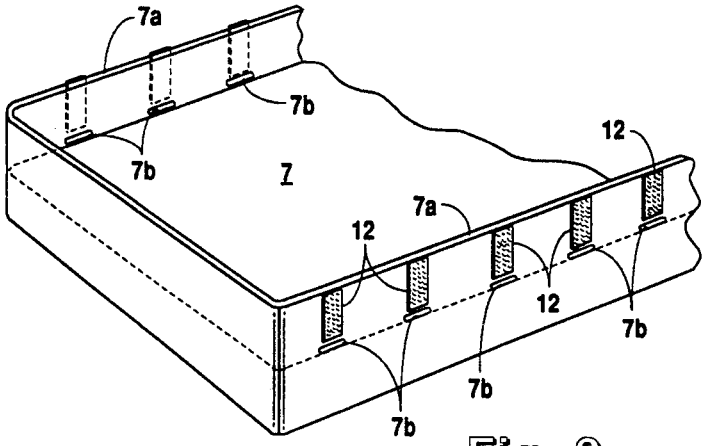

FIG. 3 is a partial perspective view of a foam pad on which the inflatable patient supporting air bags are mounted.

Figure 4:
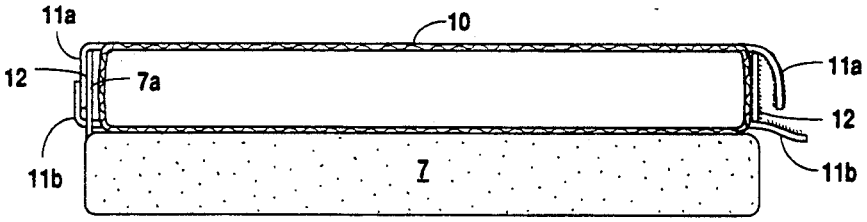

FIG. 4 is a vertical sectional view taken through one of the inflatable patient supporting air bags and the underlying foam pad.

Figure 5A:
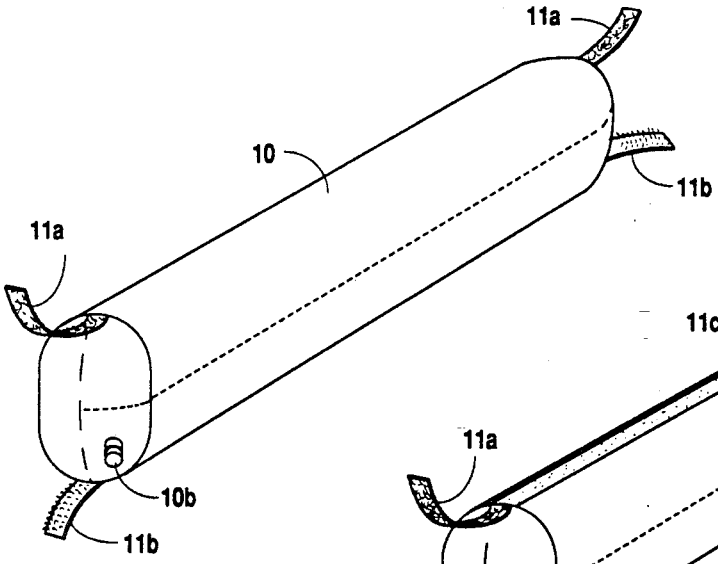

FIG. 5A is a perspective view of a patient supporting inflatable air bag.

Figure 5B:
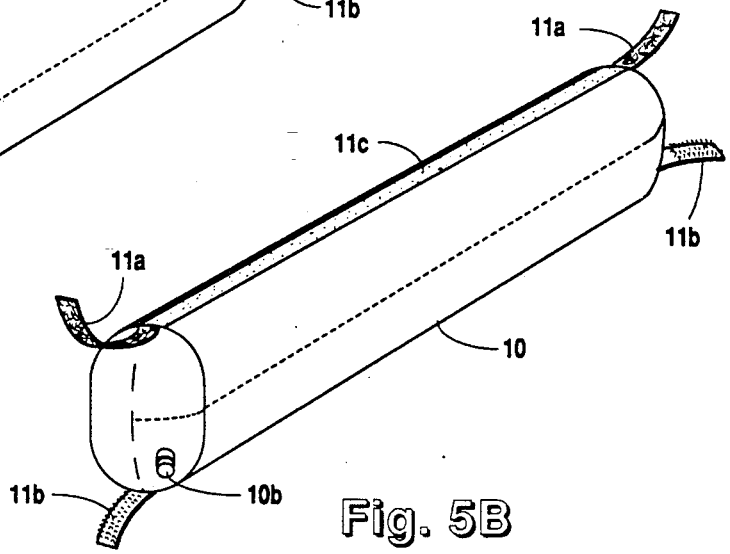

FIG. 5B is a perspective view of a patient supporting inflatable bag constructed to provide a greater air loss than the bag of FIG. 5A.

Figure 6:
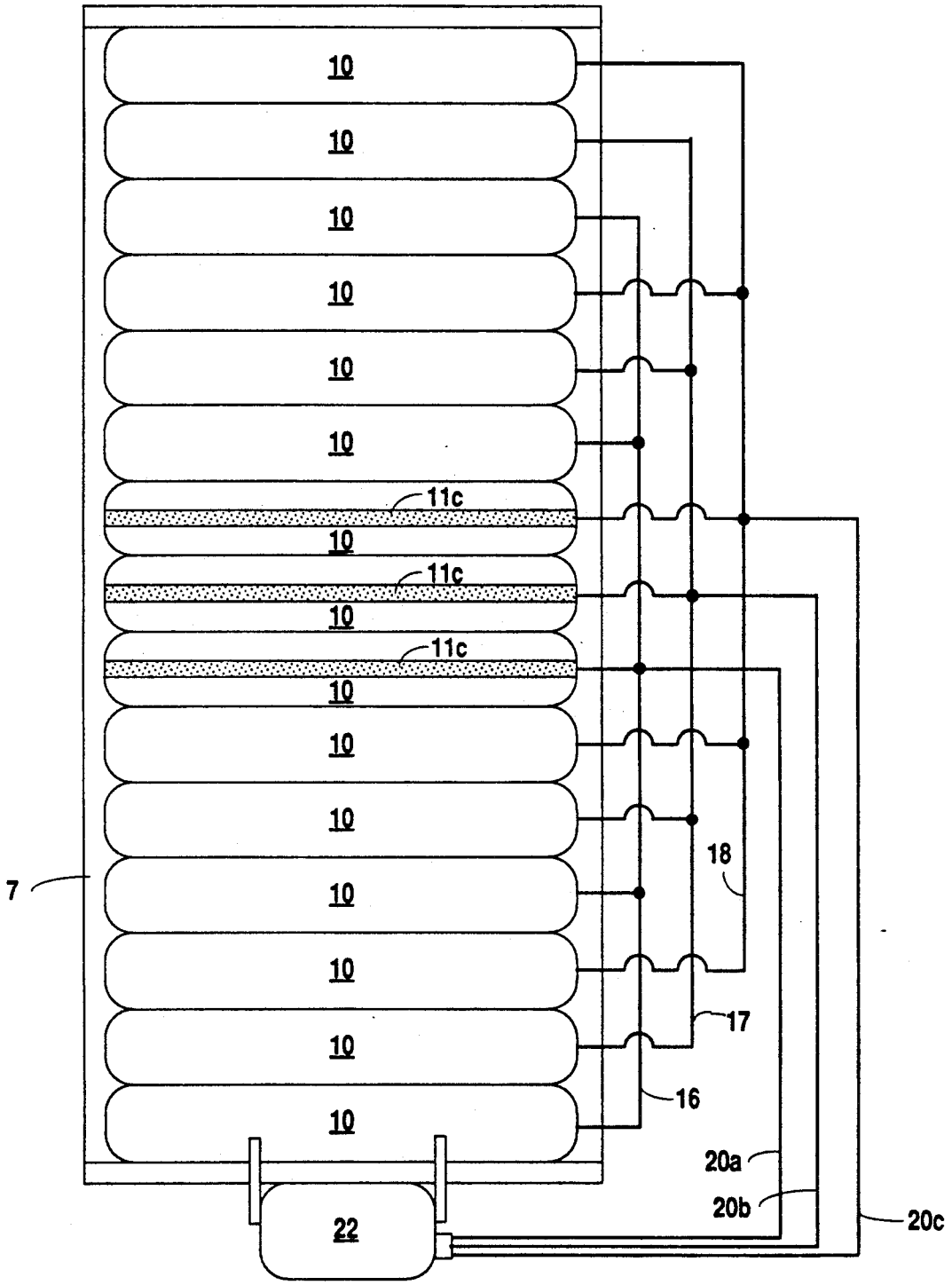

FIG. 6 is a schematic diagram of the piping for supplying pressured air to the various groups of inflatable tubular elements.

Figure 7:
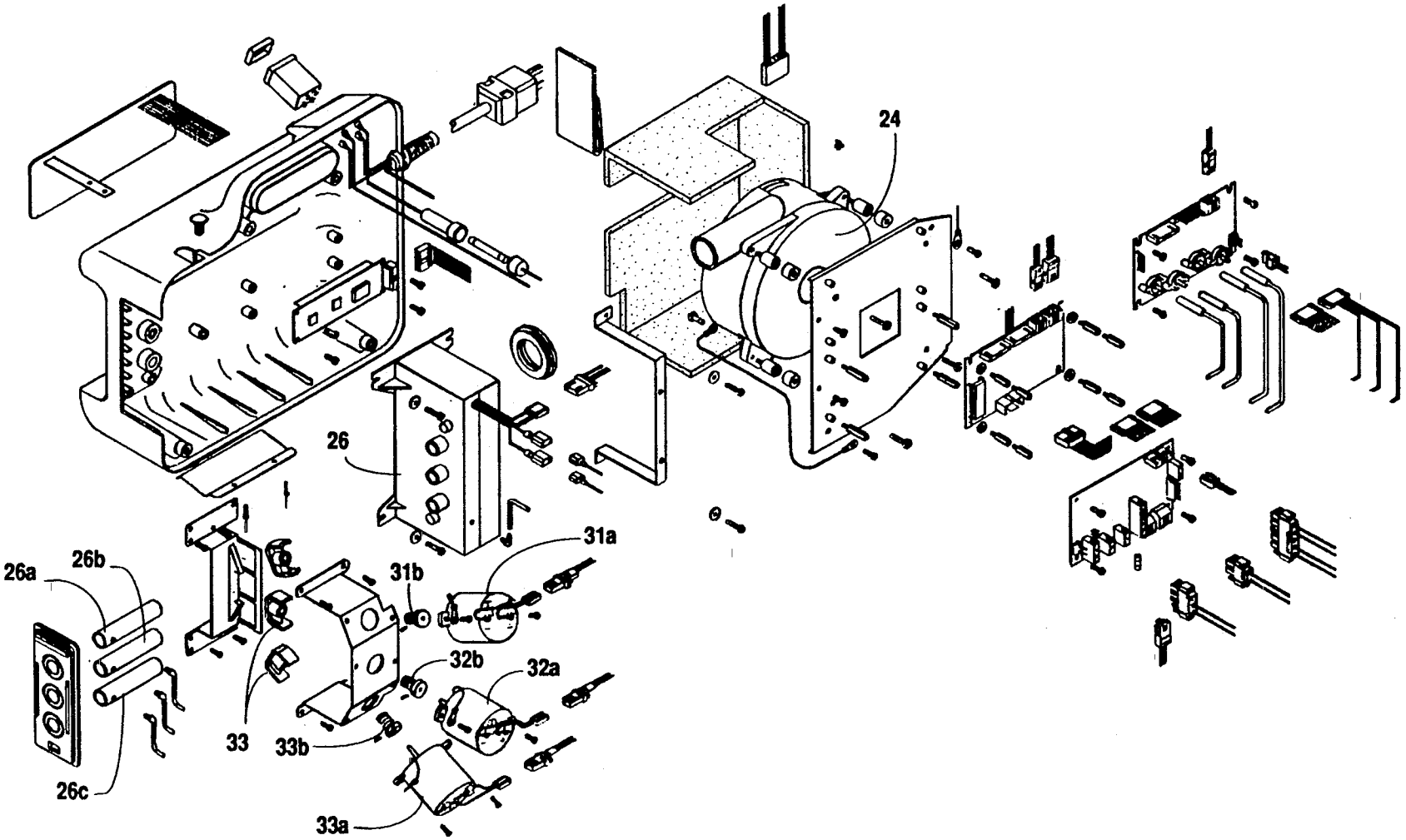

FIG. 7 is an exploded perspective view of the air pump, pressure control valves and control circuitry contained in the control box for the therapeutic mattress.

Figure 8:
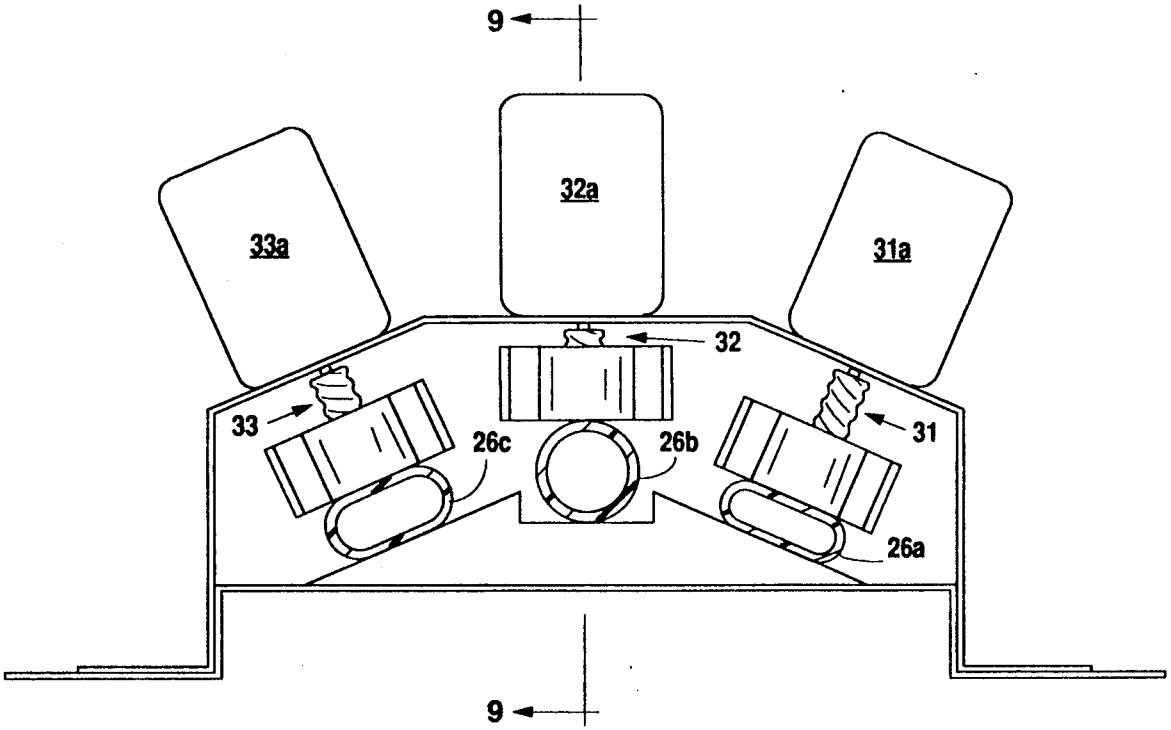

FIG. 8 is an enlarged scale elevational view of the three control valves for controlling air pressure in the three primary air supply conduits for three groups of patient supporting air bags.

Figure 9:
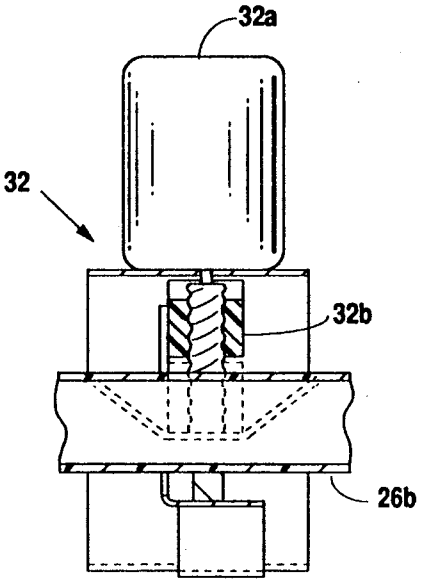

FIG. 9 is a partial sectional view taken on the plane 9—9 of FIG. 8.

DETAILED DESCRIPTION OF PREFERRED EMBODIMENTS

Referring to FIG. 1, there is shown a conventional hospital bed 1 having a main frame 1*a* supported on a plurality of depending wheels 2. Headboard 3 and footboard 4 are secured in upstanding relation to main frame 1*a*. Side rail guards 5 are pivotally mounted to the sides of main frame 1*a* and are shown in their lowered position. A mattress supporting surface 6 is mounted on main frame 1*a*.

A fabric enclosed rectangular foam pad 7 is positioned in overlying relation to mattress supporting surface 6. An upstanding fabric wall 7*a* is secured to at least the two longitudinal sides of the foam pad 7 and preferably extends around the entire periphery of pad 7 to define a peripheral wall.

A plurality of inflatable tubular elements or bags 10 formed of low air loss material are provided, one of which is shown in FIG. 5*a*. The length of tubular elements 10 corresponds to the width of the pad 7 and the inflated diameters are in the range of 4 to 6 inches, so that 12, 15 or 18 of the inflated elements 10 may be disposed in side by side relationship within the peripheral wall 7 to cover the entire area of a normal adult bed and form a patient supporting surface.

Each end of the inflatable tubular elements 10 are detachably secured to the adjacent portion of the upstanding wall 7*a*. While snap fasteners could be employed, the preferred embodiment of this invention utilizes a pair of fabric hook and loop fastener strips 11*a* and 11*b* sold under the trademark VELCRO respectively secured to the top and bottom edges of the ends 10*a* of each inflatable tubular element 10, which cooperate with a VELCRO strip 12 secured to the wall 7*a* at each position of the inflatable elements 10. See FIGS. 4 and 5A. Near the bottom of the upstanding wall 7*a*, beneath the location of each VELCRO strip 12, a slot 7*a* is provided through the wall 7*a*. The top VELCRO strip 11*a* has VELCRO fabric hooks on both of its faces. Each top strip 11*a* is folded downwardly around wall 7*a* to engage VELCRO strip 12. The bottom VELCRO strip 11*b* is inserted through the adjacent slot 7*a* and secured to the VELCRO strip on the outer face of top strip 11*a* of each inflatable element 10. Thus the inflatable tubular elements 10 are individually secured in position within the upstanding wall 7*a*.

Other alternative means for connecting the tubular elements 10 to pad 7 may also be preferred. For instance, tabls 11*a* and 11*b* may both be substituted with double-sided VELCRO loop material; and hook strips 12 may be modified to envelope tabs 11*a* and 11*b* once they are secured thereto.

If desired, for protection of the inflatable elements 10 from body fluids and to provide a smooth surface for overlaying a sheet thereon, a plastic or fabric cover 13 may be applied in the manner indicated in FIG. 1 and secured by snap fasteners 13*a* to the side of bed frame 1*a*.

As shown in FIG. 5A, each of the tubular inflatable elements 10 is inflated through a projecting filler tube 10*b*. In accordance with this invention, a plurality of longitudinally spaced inflatable elements 10 are interconnected to form a group receiving pressured air from a common supply conduit. The number of inflatable elements in each group may vary in accordance with the total number of inflatable elements. Preferably, 15 inflatable elements are utilized for the conventional adult hospital bed, so three sets of five elements in each group are formed. Thus as schematically shown in FIG. 6, starting at the footboard, the first, fourth, seventh, tenth and thirteenth elements would be interconnected by conduits 16 to a first primary conduit 20*a*. The second, fifth, eighth, eleventh and fourteenth inflatable elements would be connected by conduits 17 to a second primary conduit 20*b*. The remaining five inflatable elements would be connected by conduits 18 to a third primary conduit 20*c*. Similar groupings of sets of two, four or more may be substituted with corresponding changes in the air supply system, although primary aspects of the invention are best represented in the preferred embodiment.

The three primary conduits 20*a*, 20*b* and 20*c* extend from their respective connection points with secondary conduits 16, 17 and 18 to three sources of variable air pressure disposed in a box 22 which may be conveniently hung on the footboard 3. Within the box 22, as illustrated by FIG. 7, there is an electric motor driven air pump 24 which supplies pressured air to a header 26 having three flexible outlet pipes 26*a*, 26*b* and 26*c*. These flexible pipes respectively extend through motor controlled valves 31, 32, and 33. See FIGS. 8 and 9. The valves respectively have motors 31*a*, 32*a*, and 33*a*. Such motors are controlled to respectively provide differing degrees of axial movement of internally threaded blocks 31*b*, 32*b* and 33*b*, which compress the respective flexible outlet pipes 26*a*, 26*b* and 26*c* to vary the output pressures available at such pipes. Pipes 26*a*, 26*b* and 26*c* are respectively connected to the primary conduits 20*a*, 20*b* and 20*c*. Thus the three groups of inflatable tubular elements may be expanded or contracted by varying the outlet pressures of flexible pipes 26*a*, 26*b* and 26*c*.

Conventional manually operable controls are provided in control box 22 to provide the desired sequence of raising and lowering the fluid pressures in the various groups of inflatable tubular elements. Only a slight periodic increase or decrease in pressure from a normal median pressure is required to reduce the possibility of bed sores. Many sequences of pressure variation are possible. FIGS. 2A–2G schematically indicate a desirable sequence. In these Figures, the numeral M indicates a median inflatable pressure, H indicates a slightly higher pressure than the median, and L indicates a slightly lower pressure than the median. Thus all of the patient supporting surfaces may be periodically moved vertically in a wave-like configuration along the length of the bed to vary the pressure on those portions of the patient's body supported by a particular group of inflated tubular elements. FIG. 2A is a schematic vertical sectional view of the inflatable tubular air bags assembled on the bed of FIG. 1, illustrating a normal or level position of the patient supporting inflatable air bags. FIG. 2B is a view similar to FIG. 1 but illustrating in exaggerated dimensions a first change in the relative inflation of longitudinally spaced groups of inflatable, patient supporting bags. FIG. 2C is a view similar to FIG. 1 but illustrating in exaggerated dimensions a second change in the relative inflation of longitudially spaced groups of inflatable, patient supporting bags. FIG. 2D is a view similar to FIG. 1 but illustrating in exaggerated dimensions a third change in the relative inflation of longitudinally spaced groups of inflatable, patient supporting bags. FIG. 2E is a view similar to FIG. 1 but illustrating in exaggerated dimensions a fourth change in the relative inflation of longitudinally spaced groups of inflatable patient support air bags. FIG. 2F is a view similar to FIG. 1 but illustrating in exaggerated dimensions a fifth change in the relative inflation of longitudinally spaced groups of inflatable, patient supporting air bags. FIG. 2G is a view similar to FIG. 1 but illustrating in exaggerated dimensions a sixth change in the relative inflation of longitudinally spaced groups of inflatable, patient supporting air bags. Note, though, that other inflation sequences will still fall within certain aspects of the present invention. For instance, the cycle can be adjusted to start with all cushions partially or fully deflated and still other changes can be made, without falling outside the scope of all aspects of the invention.

While all of the inflatable tubular elements may be formed of a low air loss material, in a preferred embodiment of the invention the three inflatable elements which provide support for the buttocks and lower back portions of the patient's body are each provided with a strip of high air loss or perforated material 11, as shown in FIG. 5B, thus providing an increased flow of air, particularly heated air, to those portions of the patient's body resting thereon.

Those skilled in the art will recognize that variations in construction of the inflatable tubular elements are readily possible, and some variations have been pointed out herein. It is intended that all such variations fall within the scope of the appended claims.

What is claimed and desired to be secured by Letters Patent is:

1. A therapeutic mattress providing a generally rectangular mattress supporting surface with a length that is generally longer than its width, comprising:

a resilient pad dimensioned to generally conform to the rectangular shape of the mattress supporting surface;

first and second upstanding walls of deformable material secured in positions along each lateral side of said resilient pad;

a plurality of patient supporting inflatable tubular elements, the length of each said tubular element approaching the width of the mattress supporting surface, said tubular elements being positioned in side by side relationship and transversely oriented to span the distance between said first and second walls;

ends of said inflatable tubular elements having a pair of vertically spaced first and second hook-and-loop fastening strips, and each of said walls having means to releasably secure each of said hook-and-loop fastening strips in vertically spaced positions relative to the respective wall;

a plurality of air pressure sources;

an air control for sequentially varying the pressure outputs of said air pressure sources form a low level to a higher level and then returning to said low level and repeating the said variation;

air conduits for connecting a group of longitudinally spaced tubular elements to each said air pressure source so that each tubular element of a group may be periodically pressurized from a low level to a higher level and back to a low level by said varying pressure output of the respective one of said air pressure sources connected to said groups; and said control being adapted to time said pressure variations of said air pressure sources to occur sequentially, thereby creating a wavelike deformation of the patient supporting surfaces of said tubular elements traveling along the length dimension of the mattress.

2. The apparatus of claim 1 wherein:

said second hook-and-loop fastening strip cooperates with one side of said first hook-and-loop strip; and said tubular elements are fabricated from low air loss material.

3. The apparatus of claim 1 wherein said air conduits are disposed between one said wall and the ends of said inflatable tubular elements adjacent said one wall.

* * * * *